US007284581B2

(12) United States Patent
Steinweg

(10) Patent No.: US 7,284,581 B2
(45) Date of Patent: Oct. 23, 2007

(54) FUNNEL

(75) Inventor: Paul S. Steinweg, Lititz, PA (US)

(73) Assignee: Easco Hand Tools, Inc, Simsbury, CT (US)

( * ) Notice: Subject to any disclaimer, the term of this patent is extended or adjusted under 35 U.S.C. 154(b) by 65 days.

(21) Appl. No.: 11/354,787

(22) Filed: Feb. 15, 2006

(65) Prior Publication Data

US 2007/0186995 A1 Aug. 16, 2007

(51) Int. Cl.
*B65B 39/00* (2006.01)

(52) U.S. Cl. ..... 141/340; 141/331; 141/338; 141/368

(58) Field of Classification Search ..... 141/199, 141/297, 312, 331–345, 368
See application file for complete search history.

(56) References Cited

U.S. PATENT DOCUMENTS

| | | | | |
|---|---|---|---|---|
| 998,352 | A * | 7/1911 | Kublin | 141/300 |
| 4,028,775 | A * | 6/1977 | Tysver | 452/39 |
| 4,494,585 | A | 1/1985 | Waldecker | 141/98 |
| 4,600,125 | A | 7/1986 | Maynard, Jr. | 222/81 |
| 4,640,185 | A | 2/1987 | Joyner | 99/495 |
| 4,646,795 | A | 3/1987 | Hebron et al. | 141/98 |
| 4,703,867 | A | 11/1987 | Schoenhard | 220/85 |
| 4,712,595 | A | 12/1987 | Wilson | 141/201 |
| 4,775,629 | A | 10/1988 | Kuhl et al. | 435/299 |
| 4,832,238 | A | 5/1989 | Taylor | 222/529 |
| 5,004,024 | A | 4/1991 | Rezmer et al. | 141/298 |
| 5,020,702 | A | 6/1991 | James | 222/529 |
| 5,074,343 | A | 12/1991 | Tyree, Jr. | 141/300 |
| 5,186,358 | A | 2/1993 | McVay | 222/1 |
| 5,228,488 | A | 7/1993 | Fletcher | 141/331 |
| 5,316,059 | A | 5/1994 | Lahnan et al. | 141/340 |
| 5,322,097 | A | 6/1994 | Wright | 141/199 |
| 5,402,835 | A | 4/1995 | Middleton | 141/331 |
| 5,458,168 | A * | 10/1995 | Lindgren | 141/199 |
| 5,535,793 | A | 7/1996 | Tantre | 141/337 |
| 5,626,174 | A | 5/1997 | Schaffner | 141/386 |
| 5,634,502 | A | 6/1997 | Pierce | 141/98 |
| 5,921,296 | A | 7/1999 | Porter et al. | 141/340 |
| 5,967,201 | A | 10/1999 | Gasior | 141/98 |
| 6,341,631 | B1 | 1/2002 | Hobbs | 141/344 |
| 6,425,424 | B1 | 7/2002 | Calvo et al. | 141/331 |
| 6,752,183 | B2 | 6/2004 | Leoncavallo | 141/340 |
| 6,814,267 | B2 | 11/2004 | Ingram | 222/520 |
| 2003/0127469 | A1 | 7/2003 | Terry | 222/158 |

* cited by examiner

*Primary Examiner*—Timothy L. Maust
(74) *Attorney, Agent, or Firm*—Nelson Mullins Riley & Scarborough, L.L.P.

(57) ABSTRACT

A funnel having a receiving chamber, a neck portion, a valve and a coupler connected to the neck portion, the coupler having a housing having an axial bore formed therethrough and a cam body received therein, the cam body having an axial bore formed there through, where the cam body cams the walls of the housing radially outward between a first diameter and a second diameter.

20 Claims, 7 Drawing Sheets

FUNNEL

FIELD OF THE INVENTION

This invention relates to accessories for engines that are used in the addition or replenishment of fluids into the engine, and in particular to a funnel.

BACKGROUND OF THE INVENTION

It is well known to provide a removable cap on an inlet in the valve cover or other part of the engine in which fluids flow by gravity into the engine. Fluids are typically poured into the filler opening from a container using a funnel either placed into the filler opening or affixed to the can to direct the fluid from the container into the filler opening. Often however the filler opening is difficult to reach at close range, being obstructed by other engine components, and use of a separate funnel can result in fluid dripping from the funnel after use and during storage.

SUMMARY OF THE INVENTION

The present invention recognizes and addresses the foregoing considerations, and others, of prior art construction and methods. Accordingly, it is an object of the present invention to provide an improved e-mail system.

This and other objects are achieved by a funnel comprising a receiving chamber having a first open end and an opposite second end and a neck portion coupled to said second end, said neck portion having an axial bore formed therethrough that is in fluid communication with said receiving chamber. A connector is coupled to said neck portion and has a housing having a first end proximate said neck portion and an opposite second end distal from said neck portion. An axial bore is formed through the housing and is defined by a housing wall, said axial bore having a first diameter. The housing wall has a plurality of axial slots formed therethrough extending from said housing second end along the axial length of said housing toward said first end. A cam body has an axial bore formed therethrough that is defined by a cam body wall, and is in fluid communication with said neck portion axial bore. The cam body is received in said housing axial bore and is in operative engagement with said plurality of housing fingers so that when said cam body is moved with respect to said housing, said plurality of housing fingers are moved radially outward from a first position to a second position. A valve is operatively disposed between said neck portion axial bore and said cam body axial bore and is positional between an open position and a closed position.

In one embodiment, the valve comprises an elongated rod having a first end and an opposite second end; and a valve portion located on said elongated rod second end, which defines an opening therethrough. The elongated rod first end is coupled to said receiving chamber and said valve portion is received through said neck portion axial bore so that said valve portion operates to allow or block fluid flow through said funnel. The cam body further comprises a valve wall radially extending inward into said cam body axial bore from said cam body wall that defines an opening therethrough. The valve portion is received in said cam body axial bore proximate said valve wall so that said valve portion opening aligns with said valve wall opening when the valve is in an opened position.

In one embodiment, the housing wall defines a plurality of ramped recesses formed therein and the cam body defines a plurality of ramped lobes on an outer circumference thereof that are received in said plurality of ramped housing recesses so that when said housing is rotated with respect to said cam body, said ramped lobes cam said housing wall fingers radially outward thereby changing said housing axial bore diameter from a first diameter to a second diameter.

In one embodiment, the housing wall has a first plurality of teeth formed axially on each cam body lobe and a second plurality of teeth are formed axially in said housing wall ramped recesses. The first plurality of teeth interact with said second plurality of teeth thereby allowing said housing body to be rotated with respect to said cam body in a first direction but rotationally fixes said housing and said cam body in an opposite second direction.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
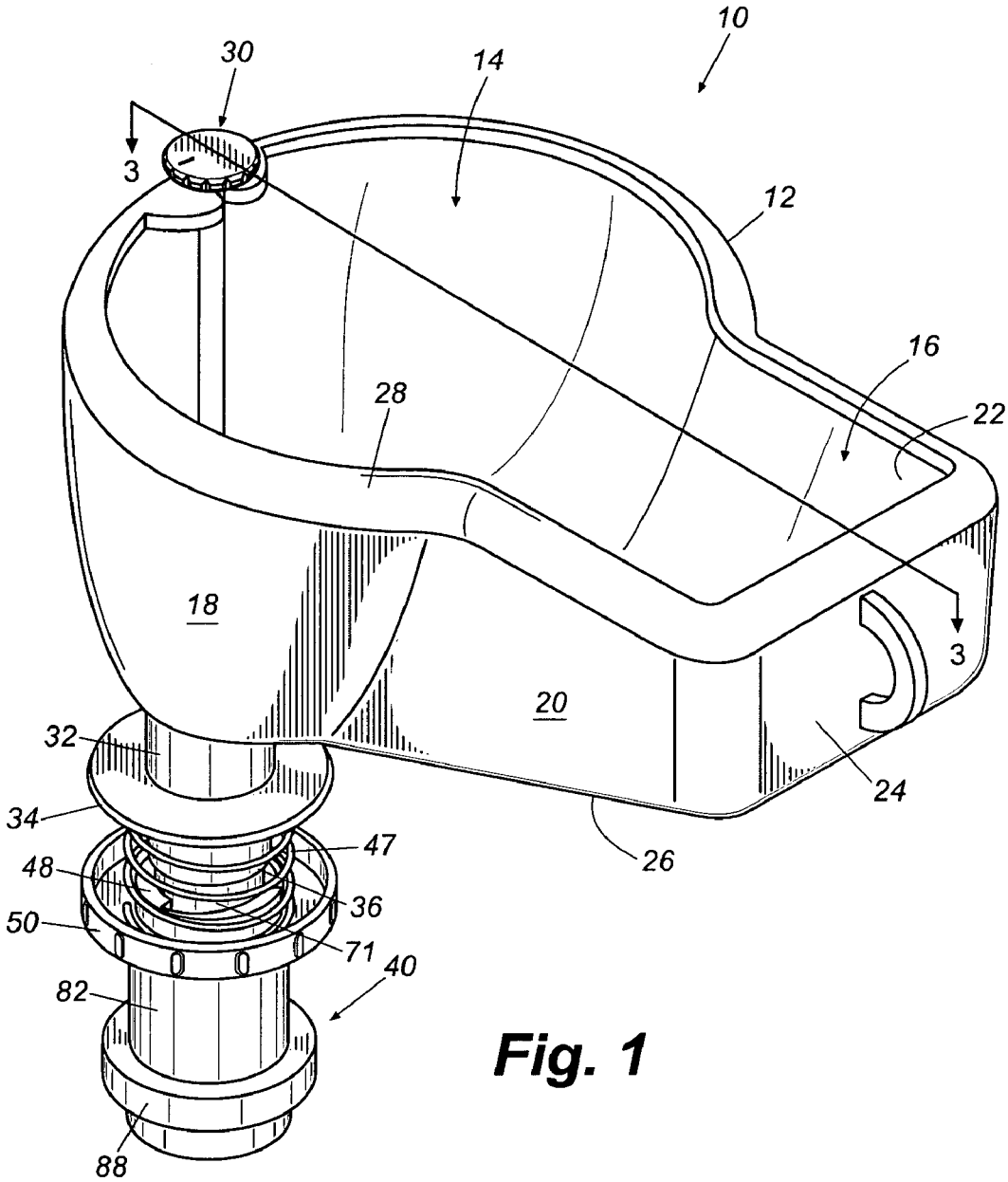
FIG. 1 is a perspective view of an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, a funnel 10 is shown having a receiving chamber 12 defined by a generally frustoconical first portion 14 and a generally square second portion 16 in fluid communication with each other. Receiving chamber 12 is coupled to a mounting section 40 and contains a valve mechanism 30. The shape described and shown in the figures facilitates the receipt of a rectangular oil container having a neck and opening formed on one end of the top.

Thus, the body of the container can be received in square portion 16 while the neck and opening can be received in frustoconical first portion 14. It should be understood that the overall shape of receiving chamber 12 may take other forms such as conical, square triangular, etc.

Figure 3:
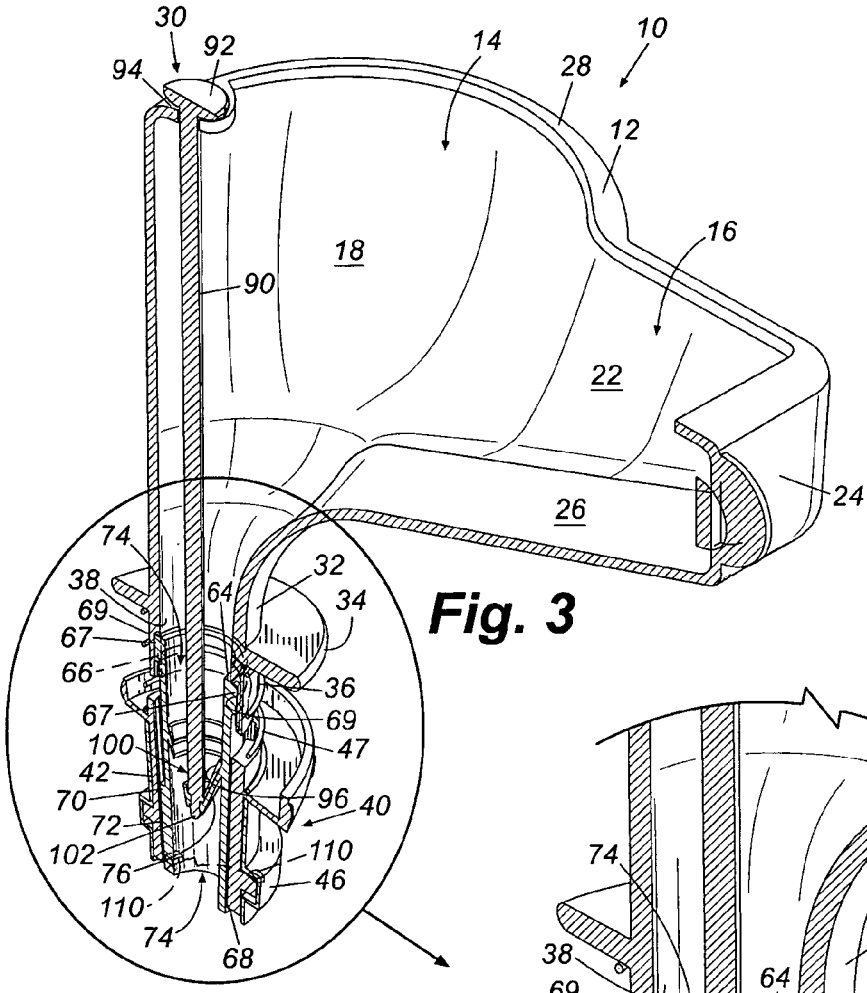
FIG. 3 is a perspective sectional view of the funnel of FIG. 1 taken along lines 3-3.

Generally frustoconical first portion 14 is defined by a side wall 18 that intersects with generally square second portion 16. Generally square second portion 16 is defined by a first and second side wall 20 and 22, respectively, a front wall 24 and a bottom wall 26 (FIGS. 1 and 3). A top end of generally frustoconical first portion 14 and generally square second portion 16 terminates at, and is integrally formed with, an inward extending flange 28 that helps to prevent fluid from splashing out or dripping from the top of the funnel. Inward extending flange 28 is coupled to one end of valve mechanism 30, as explained in further detail herein.

A bottom portion of generally frustoconical first portion 14 terminates into, and is integrally formed with, a generally cylindrical tube portion 32 that defines a radially extending flange 34 extending therefrom. Generally cylindrical tube portion 32 terminates at a bottom edge 36 (FIG. 2), and the tube portion defines an axial bore 38 (FIG. 3) therethrough that is in fluid communication with receiving chamber 12.

Figure 2:
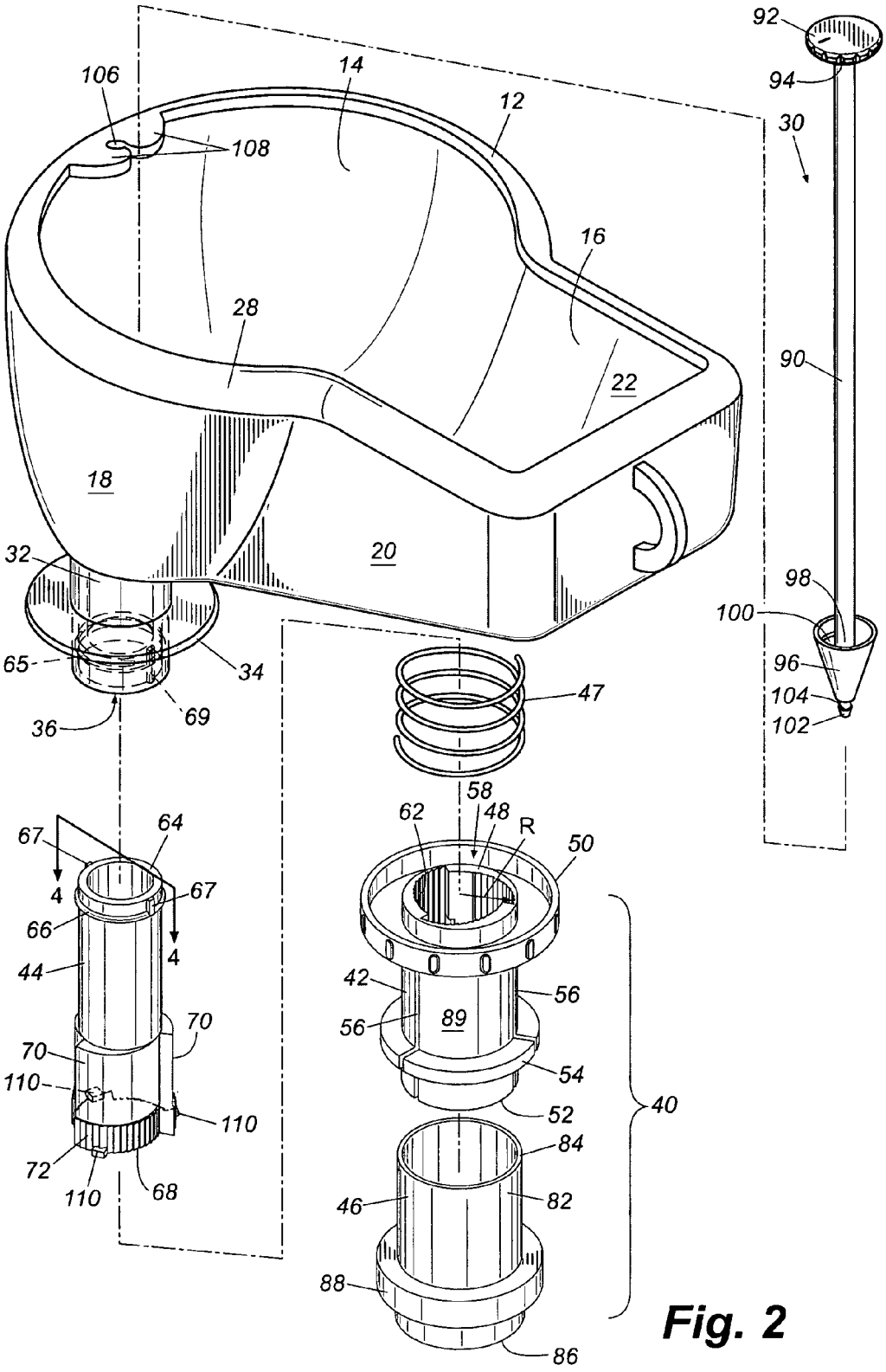
FIG. 2 is an exploded perspective view funnel of FIG. 1.

Referring to FIG. 2, mounting section 40 is formed from three main parts: a generally cylindrical housing 42, an internal cylindrical cam 44 and a boot 46. Generally cylindrical housing 42 has a first end 48 that defines a first outward radially extending flange 50 and an opposite second end 52 that defines a second outward radially extending flange 54. Axial slots 56 are formed through generally cylindrical housing 42 and extend axially from first outward radially extending flange 50 through second outward radially extending flange 54 to second end 52. The axial slots extend along about two-thirds of the length of housing 42 thereby forming multiple flexible housing fingers each defined by a portion of the housing wall located between adjacent slots. Axial slots 56 allow the portion of generally cylindrical housing 42 below first outward radially extending flange 50 to expand radially outward between a first position and a larger second position so that the diameter of the axial bore proximate housing end 52 increases from a first diameter to a larger second diameter, as explained in further detail below. Generally cylindrical housing 42 also defines an axial bore 58 therethrough that extends from first end 50 to second end 52.

Figure 2A:
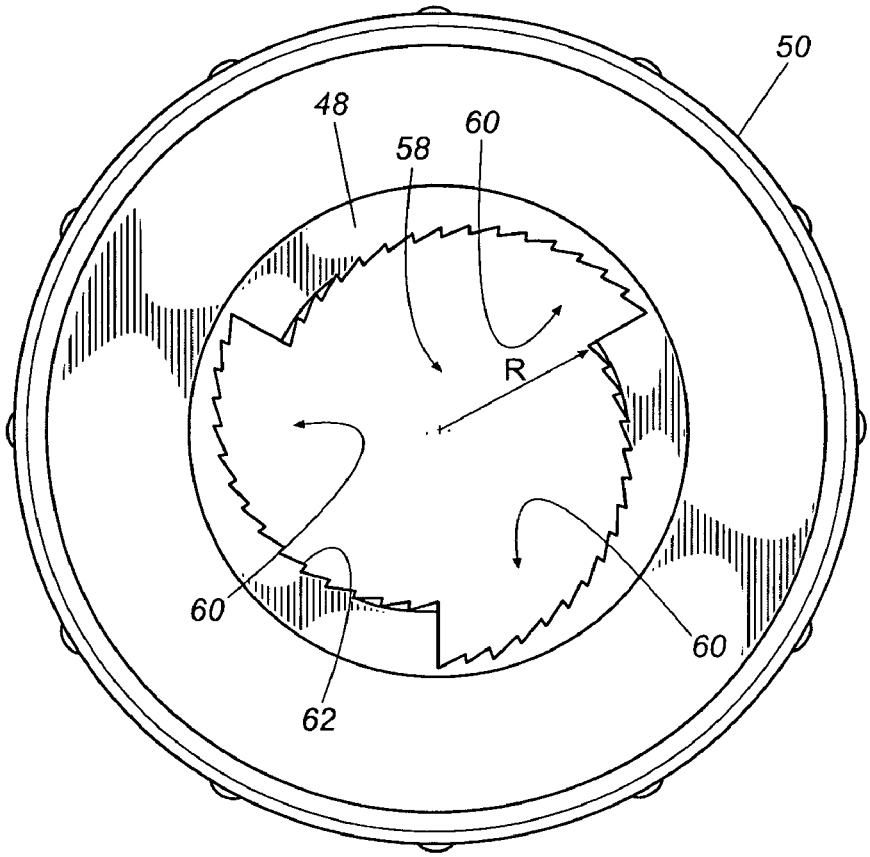
FIG. 2A is an end view of a part of the funnel of FIG. 1.

Referring to FIG. 2A, axial bore 58 has three general recessed areas 60 each formed in a housing finger and defined by a radius R that starts at a fixed length and increases as the radius is rotated about one-hundred and twenty degrees, at which point the radius starts back at the fixed length to form the next recess. Teeth 62, formed on an inner circumference of housing 42 about recesses 60, extend the length of axial bore 58. The teeth are ramped counter clockwise to allow opposing teeth formed on internal cylindrical cam 44 to ratchet over teeth 58 in one direction but not in the opposite direction.

Figure 2B:
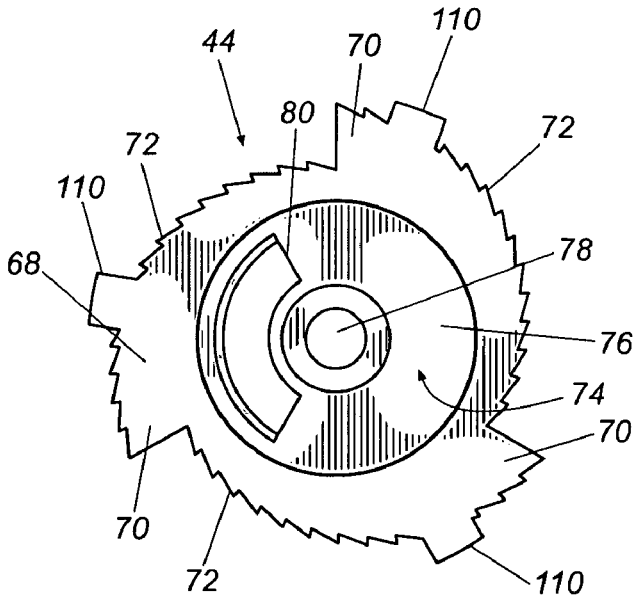
FIG. 2B is an end view of a part of the funnel of FIG. 1
Figure 4:
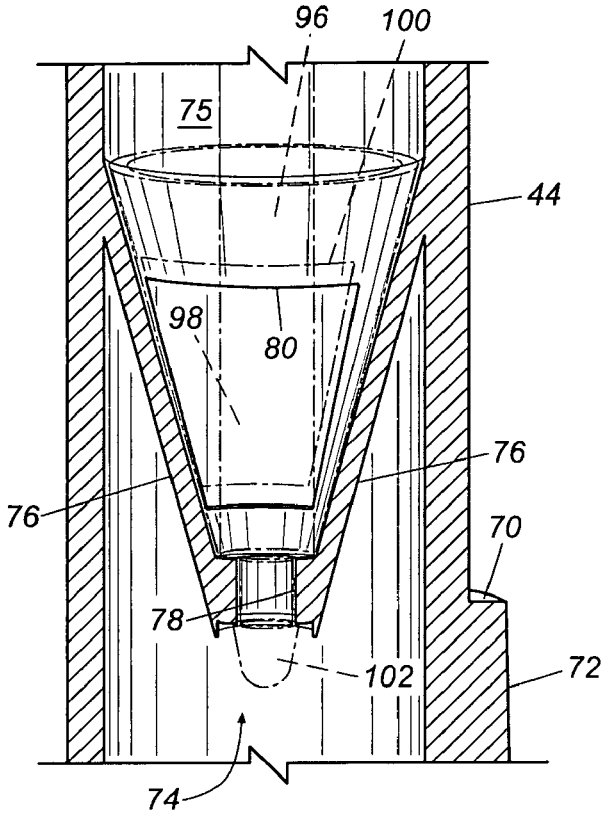
FIG. 4 is a partial plan view of the neck of the funnel of FIG. 1.

Referring to FIGS. 2 and 2B, internal cylindrical cam 44 defines a first end 64 having an outward extending flange 66 and two radially extending fingers 67 thereon, and an opposite second end 68 defining three lobes 70 (FIG. 2B) having teeth 72 formed thereon. Lobes 70 act as cam surfaces for engaging the housing fingers as described herein. Referring to FIG. 4, internal cylindrical cam 44 has an axial bore 74 formed therethrough, and a frustoconical wall 76 extends from a surface 75, defining axial bore 74, radially inward and terminates in a cylindrical opening 78. A trapezoidal shaped opening 80 is formed through a surface of frustoconical wall 76 so that the portion of axial bore 74 above frustoconical wall 76 and the portion of axial bore 74 below frustoconical wall 76 are in fluid communication with each other. Frustoconical wall 76 cooperates with valve mechanism 30 to prevent fluid from flowing through funnel 10, as further described herein.

Referring again to FIG. 2, boot 46 has a generally cylindrical main portion 82 having a first end 84 and an opposite second end 86. An outwardly extending flange portion 88 is located intermediate first and second ends 84 and 86. Boot 46 may be formed from any pliable material such as polymers and elastomers, and in one preferred embodiment boot 46 is formed from an elastomer material. The walls of boot 46 are thin and generally conform to the outer surface 89 of generally cylindrical housing 42.

Referring to FIGS. 2 and 4, valve mechanism 30 is formed from an elongated shaft 90 having a disk 92 coupled at a first end 94 and a frustoconical valve portion 96 formed at a second end 98. Frustoconical valve portion 96 contains a trapezoidal opening 100. A stem 102 is formed at second end 98 and includes a recessed groove 104. It should be understood that the valve opening can take on any shape so long as it corresponds to the shape of the opening formed in the internal cylindrical cam.

Figure 3A:
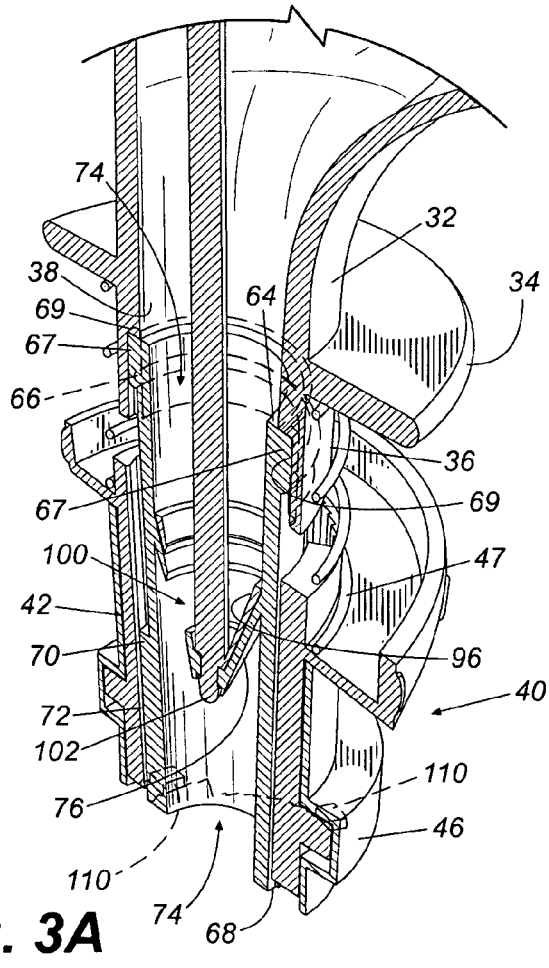
FIG. 3A is a detailed perspective view of a portion of the funnel of FIG. 3.

Referring to FIGS. 3 and 3A, funnel 10 is assembled as follows. Boot 46 may be formed separate from generally cylindrical housing 42 or molded around the housing. If formed separate, housing 42 is inserted into boot 46 by stretching the boot over the housing body. Internal cylindrical cam first end 64 is placed into housing bore 58 through housing second end 52 so that lobes 70 are received in recesses 60, and end 52 of generally cylindrical housing 42 abuts intermittent radially outward extending flanges 110 (FIG. 2). Flanges 110 prevent housing 42 from axially sliding off internal cylindrical cam 44. In this configuration, internal cylindrical cam teeth 72 interengage with housing teeth 62. Because of the shape of the teeth, housing 42 may only be rotated in the clockwise direction with respect to the view shown in FIG. 3 looking into receiving chamber 12. It should be understood that while housing 42 is prevented from sliding off internal cylindrical cam end 68 in one direction, and may only rotated with respect to the internal cam in the clockwise direction, it may slide axially in the opposite direction over a limited distance, as discussed further below.

Once housing 42 and boot 46 are installed on internal cylindrical cam 44, internal cylindrical cam first end 64 is placed into cylindrical tube portion bore 38 so that internal cylindrical cam fingers 67 are received in corresponding recesses 69 (FIG. 2) and flange 66 is received in a corresponding annular groove 65 (FIG. 2). The engagement of flange 69 and annular groove 65 axially locks internal cylindrical cam 44 with respect to generally cylindrical tube portion 32, and fingers 67 and recesses 69 rotationally lock the two parts together. A spring 47 is inserted intermediate cylindrical tube portion flange 34 and housing flange 50. When cam 44 and housing 42 are installed in cylindrical tube portion 32, an axial space 71 (FIG. 1) is provided between housing first end 48 and cylindrical tube portion end 36 to allow the housing to move axially with respect to internal cylindrical cam 44 over a limited distance defined by axial space 71. Spring 47 biases the housing axially away from cylindrical tube portion flange 34.

Referring to FIGS. 3 and 3A, valve mechanism 30 is next inserted into receiving chamber 12 such that shaft first end 94 is received in a groove 106 (FIG. 2) formed by two adjacent flanges 108. Opposite shaft end 98 is received in internal cylindrical cam bore 74 (FIG. 3A) so that valve mechanism frustoconical valve portion 96 is adjacent to internal cylindrical cam frustoconical wall 76. Valve mechanism 30 is secured in place by pushing shaft stem 102 through internal cylindrical cam opening 78 (FIG. 4) so that recessed groove 104 receives the walls defining opening 78. Once valve mechanism 30 is in place, disk 92 may rotate relative to funnel receiving chamber 12 so that Valve opening 100 may align with internal cylindrical cam opening 80 (FIG. 4). Thus, by rotating disk 92 by at least forty-five degrees, opening 80 will move out of alignment with opening 100 thereby preventing fluid flow through the funnel. Thus, Valve mechanism 30 provides the user with the ability to allow or stop fluid from flowing through funnel 10 depending on the position of valve member 30.

Figure 5:
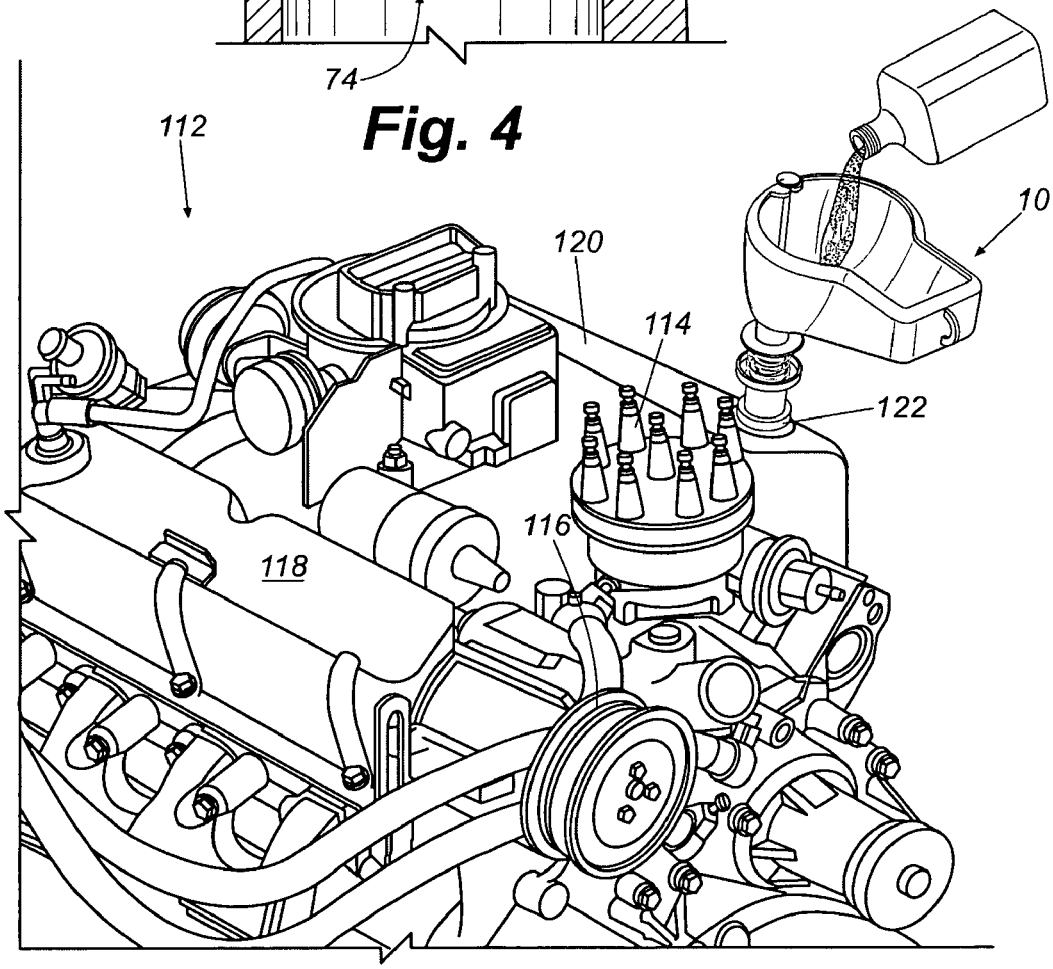
FIG. 5 is a perspective view of the funnel of FIG. 1 attached to the oil inlet of an engine.

Referring to FIG. 5, a portion of an internal combustion engine 112 is shown having a distributor cap 114, a belt pulley 116 and valve covers 118 and 120 into which funnel 10 is received. Valve cover 120 has an oil inlet 122 that defines a circular opening 123 (shown in phantom in FIGS. 6A-6C) for the addition of oil into the engine.

Figure 6A:
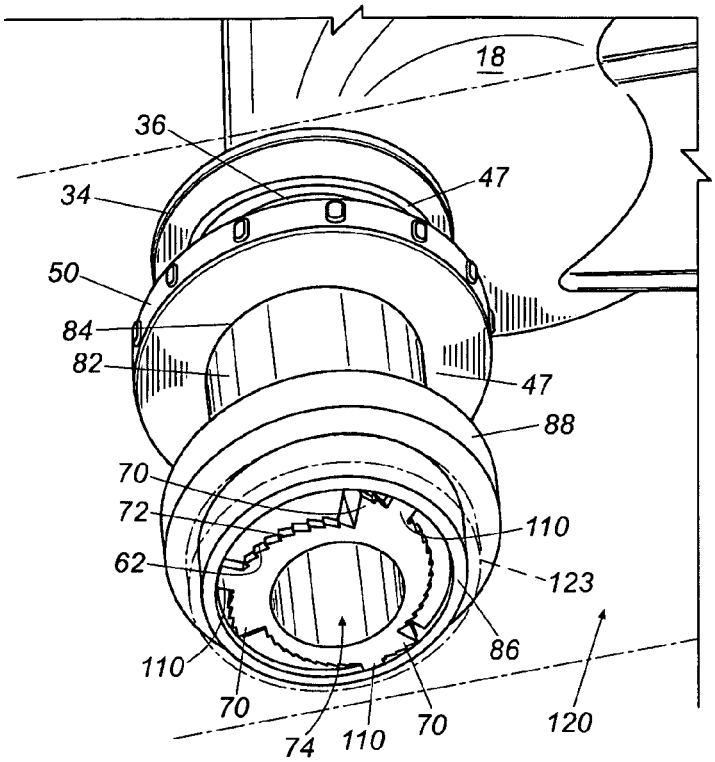
FIGS. 6A-6C are perspective views of the funnel in use.

Referring to FIG. 6A, in use funnel 10 is positioned so that mounting section 40 is within inlet opening 123 with housing flange 88 abutting the top of inlet 122. Inlet opening 123 and the inside of valve cover 120 are shown in phantom. Looking into housing end 86, lobes 70 align with recess 60 so that the diameter of housing 42 is generally constant along the axial length of housing 42. Once the funnel is properly positioned, the user rotates generally cylindrical tube portion 32 and receiving chamber 12 counterclockwise with respect to generally cylindrical housing 42 so that internal cylindrical cam teeth 72 ride over housing teeth 62. The relative rotation causes the lobes to bias the recess walls radially outward and into engagement with the wall of opening 123.

Figure 6B:
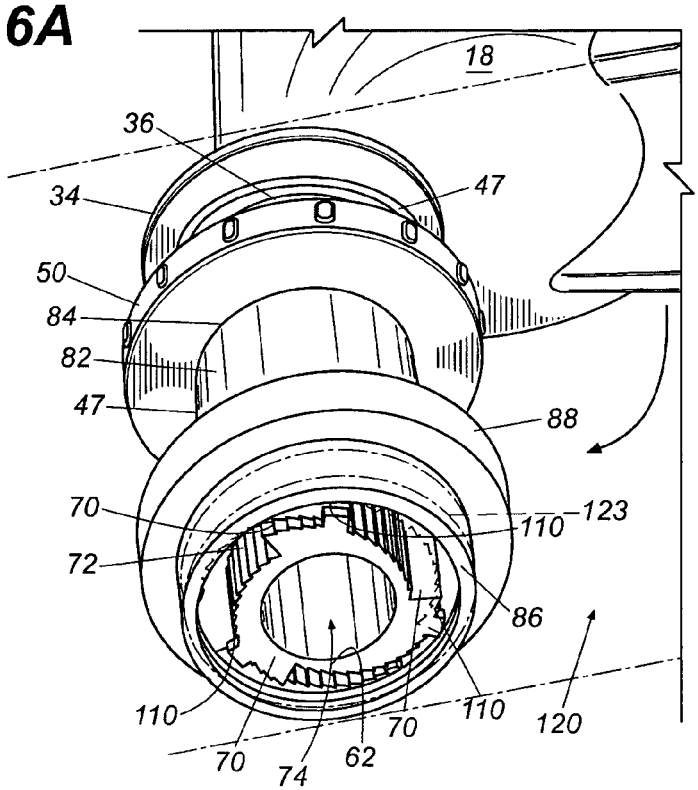

It should be understood that the user can rotate housing 42 relative to internal cylindrical cam 44 in one of two ways. First, the user can hold housing 42 stationary by gripping flange 50 and rotate internal cylindrical cam 44 with respect to the housing by turning receiving chamber 12. Alternatively, the user may hold internal cylindrical cam 44 stationary through receiving chamber 12 and rotate housing 42 relative to the cam. In either case, the housing teeth ride over the cam teeth so that the radially larger parts of the lobes engage the radially smaller parts of the recess causing the diameter of housing end 52 to increase (FIG. 6B). As a result, the outer surface of boot end 86 engages the inner circumference of oil inlet circular opening 123 causing a tight seal to form. The radius of housing end 52 may increase by 0.45 inches and can fit into openings ranging from 1.15 inches (31 mm) to 1.60 inches (43 mm) in diameter.

Once the oil funnel is engaged with the opening, disk 92 may be rotated so that valve mechanism opening 100 aligns with internal cam opening 80. In this configuration, the user can pour fluid into funnel 10 (FIG. 5) to fill the fluid reservoir. Once the user finished filling the reservoir, disk 92 is rotated by at least forty-five degrees so that opening 100 moves out of alignment with opening 80. This prevents fluid from passing though the funnel and spilling from mounting end 40 onto the automobile engine or exterior finish.

Figure 6C:
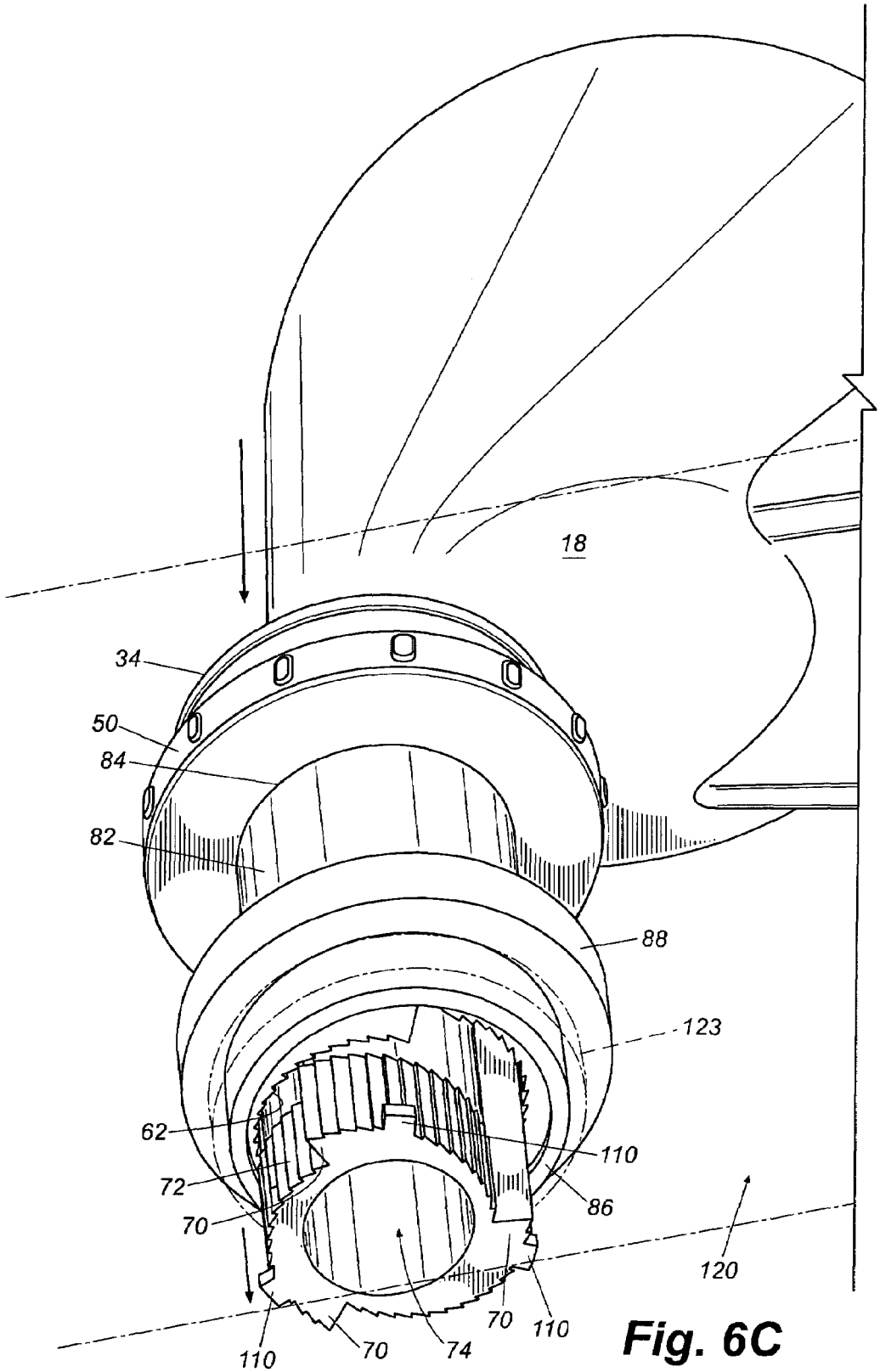

Referring to FIG. 6C, the funnel may be released from inlet opening 123 by axially moving internal cylindrical cam 44 relative to housing 42. In particular, the user may press down on receiving chamber 12 causing internal cylindrical cam end 68 to push through housing end 52. In particular, as the housing moves relative to the internal cylindrical cam, housing flange 50 moves toward flange portion 34 against the bias of spring 47. Thus, as the cam is pushed through the housing, cam teeth 72 disengage from housing teeth 62 (FIG. 6C) allowing housing end 86 to decrease in radial diameter thereby releasing the funnel from the inlet.

After the funnel is released and removed from the inlet, the user can realign lobes 70 with recesses 60 by move rotating housing 42 with respect to internal cylindrical cam 44 until the lobes align with the recesses. Once aligned, housing 42 may be moved axially along internal cylindrical cam 44 until intermittent flanges 110 abut with housing end 86.

What is claimed is:

1. A funnel comprising:

a. a receiving chamber having a first open end and an opposite second end;

b. a generally cylindrical neck portion coupled to said second end, said neck portion having an axial bore formed therethrough that is in fluid communication with said receiving chamber through said second end; and c. a connector coupled to said neck portion, said connector comprising, (i) a generally cylindrical housing having an axial bore formed therethrough that is defined by a wall of said housing, said housing axial bore having a first diameter, and (ii) a generally cylindrical cam body having at least one cam surface, and an axial bore formed through said cam body that is defined by a wall of said cam body, said cam body axial bore being in fluid communication with said neck portion axial bore, wherein said cam body is received in said housing axial bore and is in operative engagement with said housing wall so that when said cam body is moved with respect to said housing said housing axial bore diameter changes from said first diameter to a larger second diameter.

2. The funnel of claim 1, further comprising a valve mechanism comprising, a. an elongated rod having a first end and an opposite second end; and b. a valve portion located on said elongated rod second end, said valve portion having an opening formed therethrough, wherein said elongated rod first end is coupled to said receiving chamber and said valve portion is received through said neck portion axial bore so that said valve portion operates to allow or block fluid flow through said funnel.

3. The funnel of claim 2, said cam body further comprising:

a. a valve wall radially extending inward into said cam body axial bore from said cam body wall; and b. an opening formed through said valve wall;

wherein said valve portion is received in said cam body axial bore proximate said valve wall so that said valve portion opening can align with said valve wall opening.

4. The funnel of claim 1, wherein a. said housing wall defines a plurality of ramped recesses therein;

b. said at least one cam body surface further comprising a plurality of ramped lobes on an outer circumference of said cam body wall that are received in said plurality of ramped housing recesses so that when said housing is rotated with respect to said cam body wherein each one of said plurality of ramped lobe cams said housing wall radially outward thereby changing said housing axial bore diameter from said first diameter to said second diameter when said cam body is moved relative to said housing.

5. The funnel of claim 4, further comprising a first plurality of teeth formed axially on each cam body lobe and a second plurality of axial teeth formed on said housing wall of said ramped recesses, wherein a. said first plurality of teeth interact with said second plurality of teeth, and b. said first and said second plurality of teeth allow said housing body to be rotated with respect to said cam body in a first direction but rotationally fix said housing and said cam body in an opposite second direction.

6. The funnel of claim 3, wherein said cam body valve wall is frustoconical in shape and said valve portion is frustoconical in shape so that said frustoconical valve portion is received adjacent to said frustoconical cam body valve wall.

7. The funnel of claim 1, wherein a. said housing has a first end proximate said neck portion and an opposite second end distal from said neck portion; and b. said generally cylindrical housing wall has a plurality of axial slots formed therethrough extending from said housing second end approximately along two-thirds of the axial length of said housing;

wherein said cam surface is located proximate said housing second end.

8. The funnel of claim 7, wherein a. said plurality of axial slots define a plurality of flexible fingers each defined by a portion of said housing wall located between adjacent axial slots, and b. each finger moves radially outward changing said diameter of said housing axial bore between said first diameter and said second diameter.

9. The funnel of claim 1, wherein said cam body is rotationally and axially fixed to said neck portion, and said housing is rotatable and axially moveable with respect to said cam body.

10. The funnel of claim 9, wherein when said housing is moved axially with respect to said cam body, said at least one cam surface disengages from said housing wall allowing said diameter of said housing axial bore to change from said larger second diameter to said first diameter.

11. The funnel of claim 1, further comprising a flexible layer of material disposed on an outer surface of said housing.

12. A funnel comprising:

a. a receiving chamber having a first open end and an opposite second end;

b. a neck portion coupled to said second end, said neck portion having an axial bore formed therethrough that is in fluid communication with said receiving chamber;

c. a connector coupled to said neck portion, said connector comprising, (i) a housing having an axial bore formed therethrough that is defined by a housing wall, said axial bore having a first diameter, (ii) a cam body having a plurality of cam surfaces in operative engagement with said housing wall, and an axial bore formed through said cam body that is defined by a cam body wall, said cam body axial bore being in fluid communication with said neck portion axial bore, wherein said cam body is received in said housing axial bore so that when said cam body is moved with respect to said housing, said plurality of cam surfaces bias said housing wall so that said housing axial bore diameter changes from said first diameter to a larger second diameter; and d. a valve operatively disposed between said neck portion axial bore and said cam body axial bore, wherein said valve is moveable between an open position and a closed position.

13. The funnel of claim 12, said valve comprising:

a. an elongated rod having a first end and an opposite second end; and b. a valve portion located on said elongated rod second end, said valve portion having an opening formed therethrough, wherein said elongated rod first end is coupled to said receiving chamber and said valve portion is received in said cam body axial bore so that said valve portion operates to allow or block fluid flow through said funnel.

14. The funnel of claim 12, wherein a. said cam body is rotationally and axially fixed to said neck portion, and b. said housing is rotatable and axially moveable with respect to said cam body.

15. The funnel of claim 12, wherein a. said housing has a first end proximate said neck portion and an opposite second end distal from said neck portion; and b. said housing wall has a plurality of axial slots formed therethrough extending from said housing second end along the axial length of said housing toward said first end;

wherein said plurality of axial slots define a plurality of flexible fingers each defined by a portion of said housing wall located between adjacent axial slots, and each finger moves radially outward when one of said plurality of cam surfaces engage said finger changing said diameter of said housing axial bore between said first diameter and said second diameter.

16. The funnel of claim 15, wherein a respective one of said plurality of cam surfaces cams a respective one of said plurality of flexible fingers radially outward when said cam body is rotated with respect to said housing.

17. The funnel of claim 16, wherein a respective one of said plurality of cam surfaces releases a respective one of said plurality of flexible fingers radially inward when said cam body is moved axially with respect to said housing.

18. A funnel comprising:

a. a receiving chamber having a first open end and an opposite second end;

b. a neck portion coupled to said second end, said neck portion having an axial bore formed therethrough that is in fluid communication with said receiving chamber;

c. a connector coupled to said neck portion, said connector comprising, (i) a housing having a first end proximate said neck portion and an opposite second end distal from said neck portion an axial bore formed therethrough that is defined by a housing wall, said axial bore having a first diameter, and a plurality of axial slots formed in said housing wall and extending from said housing second end along the axial length of said housing toward said first end, wherein said plurality of axial slots define a plurality of flexible fingers each defined by a portion of said housing wall located between adjacent axial slots and, (ii) a cam body having an axial bore formed therethrough that is defined by a cam body wall, said axial bore being in fluid communication with said neck portion axial bore, and a plurality of cam surfaces on an outer circumference of said cam body wall, wherein said cam body is received in said housing axial bore so that a respective one of said plurality of cam surfaces is in operative engagement with a respective one of said plurality of housing fingers so that when said cam body is moved with respect to said housing, said plurality of housing fingers are moved radially outward from a first position to a second position.

19. The funnel of claim 18, wherein a. said cam body is rotationally and axially fixed to said neck portion, and b. said housing is rotatable and axially moveable with respect to said cam body.

20. The funnel of claim 19, wherein when said housing is moved axially with respect to said cam body, said plurality of cam surfaces disengage from said plurality of housing fingers allowing said plurality of housing fingers to move from said second position to said first position.

* * * * *